US005848710A

United States Patent [19]

Pomper

[11] Patent Number: 5,848,710

[45] Date of Patent: Dec. 15, 1998

[54] MERCHANDISE DISPLAY STAND

[76] Inventor: Yael Sonia Pomper, 715 Park Ave., Apt. 6B, New York, N.Y. 10021

[21] Appl. No.: 891,898

[22] Filed: Jul. 14, 1997

[51] Int. Cl.[6] ..... A47F 7/00

[52] U.S. Cl. ..... 211/85.2; 211/4; 211/205; 248/551

[58] Field of Search ..... 211/4, 85.2, 61, 211/205, 196, 7, 163; 248/551, 156

[56] References Cited

U.S. PATENT DOCUMENTS

| | | | |
|---|---|---|---|
| 1,445,803 | 2/1923 | Small et al. | 211/4 |
| 3,424,317 | 1/1969 | Singer | 211/196 X |
| 3,768,662 | 10/1973 | Ritzen | 211/4 |
| 4,390,099 | 6/1983 | Trautlein et al. | 211/85.2 X |
| 5,054,624 | 10/1991 | Camp | 211/85.2 |
| 5,487,600 | 1/1996 | Gviffin | 211/85.2 X |

*Primary Examiner*—Robert W. Gibson, Jr.
*Attorney, Agent, or Firm*—Bauer & Schaffer

[57] ABSTRACT

A vertical post assembly is mounted on a substantially horizontal base and has at the upper end a plurality of spokes upon which the merchandise is hung and a separate continuous ring. The spokes and/or the ring are selectively movable relative to each other between a first position wherein the ring abuts with the end of the spokes preventing removal of the merchandise, and a second position spaced from one or more of the spokes to free the ends thereof, permitting removal of the merchandise.

9 Claims, 2 Drawing Sheets

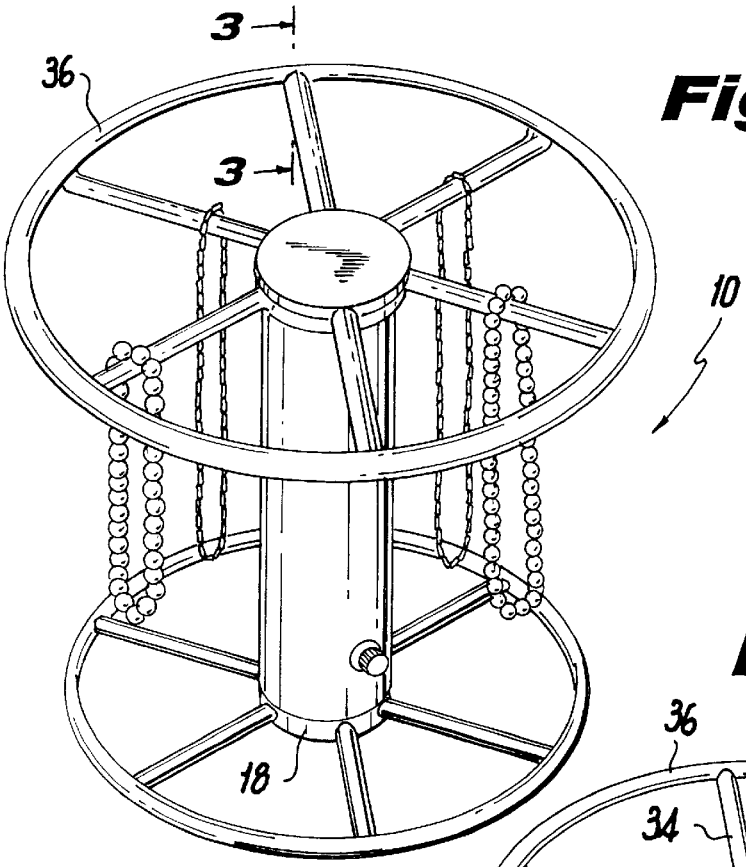
Fig. 1
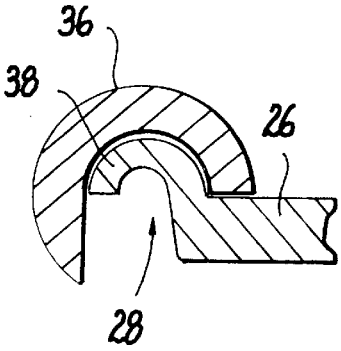
Fig. 3
Fig. 2
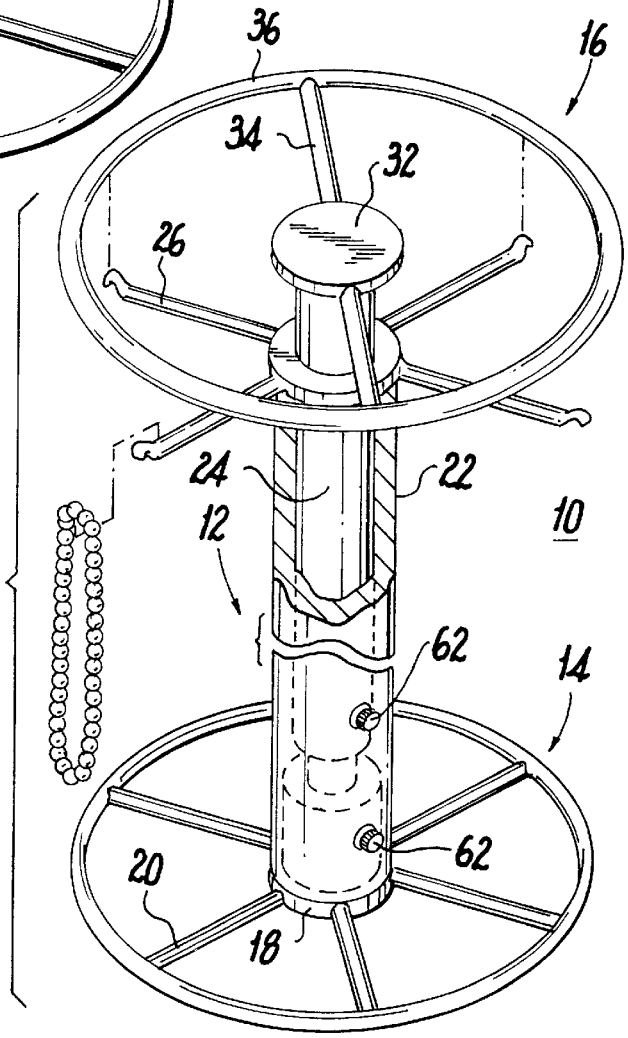

Fig. 4
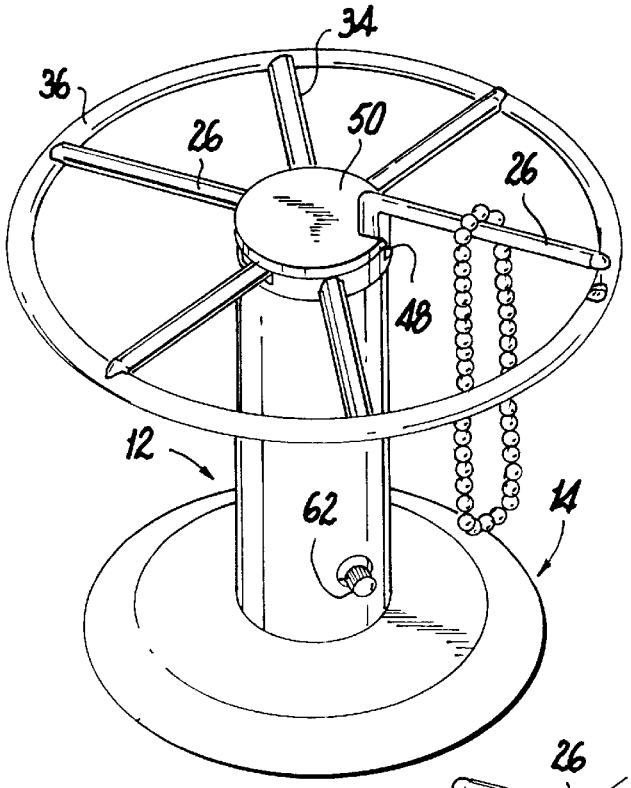
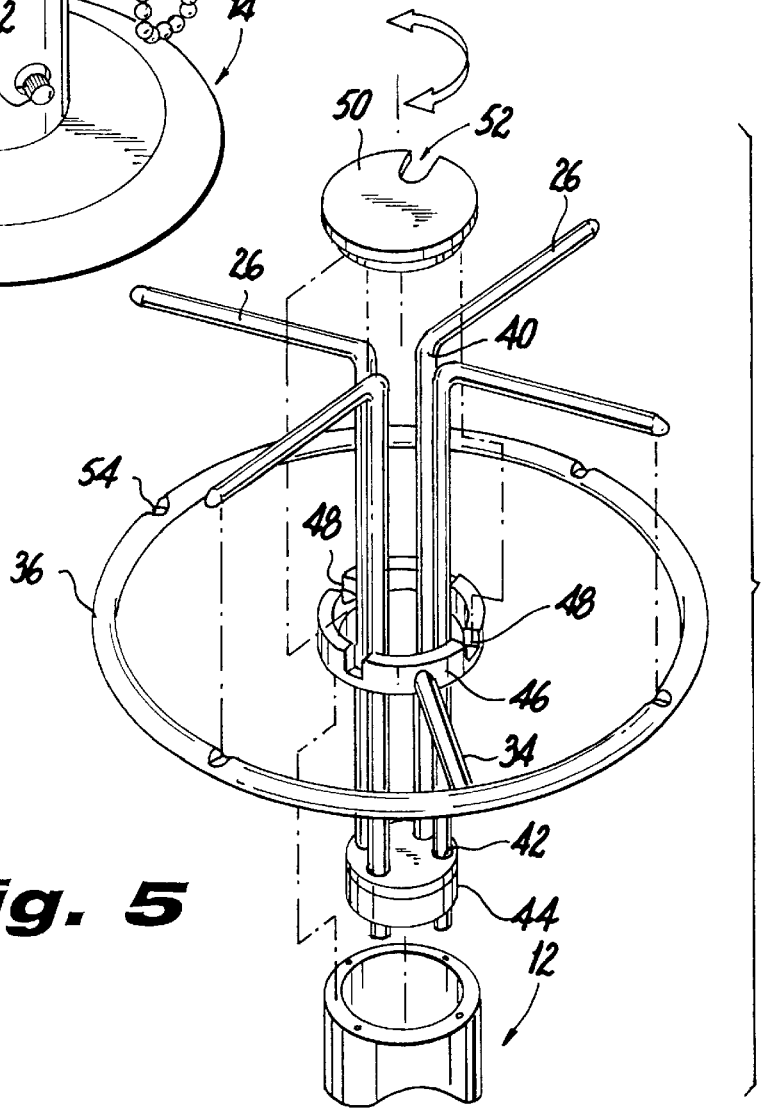
Fig. 5

MERCHANDISE DISPLAY STAND

BACKGROUND OF THE INVENTION

The present invention relates to display fixtures for holding merchandise, and more particularly, to a pilfer resistant display stand which supports jewelry chains or necklaces in such manner that unauthorized removal cannot be made.

Display fixtures are known for holding a variety of jewelry articles such as earrings, bracelets, necklaces, rings and the like. Department stores, specialty stores and the like prefer to exhibit such articles prominently to prospective customers and browsers.

Pilferage or theft of such merchandise is a critical problem, and large sums of money are lost each year due to the inability to adequate protective measures.

Accordingly, one object of the present invention is to provide an improved display fixture for holding and exhibiting jewelry articles.

Another object is to provide a display stand for jewelry chains and necklaces, which includes features for preventing or minimizing theft or pilferage therefrom.

A further object is to provide an anti-theft display stand which permits jewelry articles to be readily mounted or removed therefrom by authorized personnel, while preventing removal of such articles by unauthorized personnel.

Another object is to provide a jewelry display device which is simple in construction, aesthetically appealing, and relatively inexpensive to manufacture.

These objects together with other advantages are set forth in the following disclosure of the present invention.

SUMMARY OF THE INVENTION

In general, the display stand of the present invention comprises a vertical post assembly mounted on a substantially horizontal base. Mounted on the upper end of the post is a plurality of spokes upon which the merchandise is hung and a separate continuous ring. The spokes and/or the ring are selectively movable relative to each other between a first position wherein the ring abuts with the end of the spokes preventing removal of the merchandise, and a second position spaced from one or more of the spokes to free the ends thereof, permitting removal of the merchandise.

In one embodiment, the post comprises an assembly of an inner and outer tube, the spokes being mounted on one tube and the ring on the other. The tubes are telescoped one into the other so that on relative movement of the posts, the spokes and rings are selective movable into the first and second positions.

In another embodiment, the ring is mounted on the inner post so as to be rotatable, but not linearly moveable. The inner post has a slot wide enough to allow a single spoke to move upwardly therethrough. The spokes are mounted between the inner and outer tubes and are individually liftable through the slot, lift also causes the end of spokes to be free of contact with the ring.

The display stand is provided with means to lock and open the ring and spokes operable only by the salesperson or shopkeeper.

Full details of the present invention are set forth in the following description of the invention.

BRIEF DESCRIPTION OF THE DRAWINGS

The invention will be best understood by reference to the following drawings, wherein:

FIG. 1 is a perspective view, partially sectioned, of a display stand constructed in accordance with the invention in its closed or pilfer proof position;

FIG. 2 is an enlarged view of the display stand showing the internal construction of the post assembly;

FIG. 3 is a sectional view taken along line 3—3 of FIG. 2;

FIG. 4 is a view similar to that of FIG. 1 showing another embodiment of the invention; and FIG. 5 is a view similar to FIG. 2 showing the internal construction thereof.

DESCRIPTION OF THE INVENTION

Briefly as seen in the Figures, the display stand designated generally by reference numeral 10, comprises three major portions namely, a vertically oriented center post 12, a base 14 and a display assembly 16 horizontally aligned and elevated with respect to the base 14.

While the base 14 is conveniently formed in the shape of a wheel having a central hub 18 and a plurality of spokes 20, it may, in fact, take any shape or form. A generally flat plate of rectangular oval or circular shape will make a more than adequate base. The post 12 compasses an outer tube 22 in which is telescoping located in an inner support tube 24. The lower end of the outer post 22 is removably secured in the hub 18 of the base. Where a wheel like base is not used, the base should be provided with a central opening, i.e., hub to removably receive the post. Both the post and hub preferably have mating threads to allow the post to be screwed onto the plate.

Integrally attached to the upper end of the outer tube 22, are a plurality of radial spaced spokes 26 adapted to hold the merchandise to be displayed.

As seen in FIG. 3, the spokes 26 terminates at their outer ends in a downwardly directed hook 28, having a small nub 30 on its upper surface. A cap 32 is threaded on to the upper end of the inner post 24 and is provided with a pair diametrically extending arms 34 to the radially outer ends of which is attached a ring 36. As seen in FIG. 3, the cross section of the ring 36 has a curved outer surface and a partially hollow inner surface forming a modified U-shaped trough 38 with one leg longer than the other. This cross section defines a pocket 38 into which the hook 28 fits and the nub 30 seats. The ring is otherwise solid and completely continuance about its circumference. The diameter of the ring is such as to approximate the diameter of the spokes 26 is such that the ring 36 overlies, abuts and hides the ends of the spokes 26 when the inner tube 24 is fully telescoped within the outer tube 22.

The base 14 may be larger in diameter than the display ring 36, although, this is not essential for stability. The base may be smaller, or the base and ring may be of the same diameter, since all of the merchandise being displayed will be on the support spokes well within the confines of the ring 36 so that the center of gravity is within the base.

In use, the inner tube 24 is raised, as seen in FIG. 1, relative to the outer tube elevating the ring 36 and freeing the hook ends 28 of the spokes 26. This allows the shopkeeper or clerk to hang the merchandise such as belts, jewelry, necklaces etc. by their closed loops, bands or the like on the spokes over the nub 30. Upon lowering the inner tube, the ring abuts the spoke ends and locks the merchandise on the display stand.

In FIGS. 5 and 6 another embodiment is shown wherein the spokes 26 are integrally formed at the end of an elongated vertical rod 40, in a L-shaped fashion. The long vertical rod 40 passes loosely through the respective holes 42, in a stabilizing block 44, held in the outer tube 22 and extends towards the lower end of the tube 22. At the upper end of the tube 22, is secured, as by threading, a collar 46 having a plurality of notches 48, in which the spokes 26 sit. Rotably mounted on the collar 46 is a cap 50 having a single radial cutout or slot 52. The surrounding wheel 36 is provided with a plurality of indents or recesses 54 on its top surface into which the ends of the spokes 26, which are not bent or hooked, are received.

In use, the embodiment of FIGS. 5 and 6 is also simple. The rotating cap 50 is moved in line with the spokes 26 holding the merchandise to be closely examined, and the selected spoke is lifted through slot 52. When inspection has been completed, the spoke is returned to sit in the slot 52 and the cap 50 rotated so as to cover all of the spokes.

While the operation of either embodiment, the display stand may be made by merely lifting the supporting inner tube 24 by hand, it is preferred to provide for remote operations of the display stand. To this end, the embodiment of FIGS. 1–4 can be provided with a double acting piston/cylinder assembly 60 placed between the bottoms of the telescoping tube. Each end of the piston/cylinder assembly 60 is connected via an inlet outlet plug 62 by conduit 64 leading to and from a source 66 of fluid under pressure preferably, air, located remotely from the display case and provided with conventional controls operable only by the salesperson. Such a system will lock the display stand, when the ring 36 is closed on the spokes 26. Since the piston/cylinder system cannot be manually operated, the inner tube cannot be manually lifted by a thief without the approval of the clerk or shopkeeper.

A second and simple system employing the inner and outer tubes as piston/cylinder can be employed by capping or hermetically sealing the bottom end of the outer tube and sizing the inner tube so that inner tube slides piston-like within the outer tube. If desired, an O-ring piston seal 68 may be provided for sealing the inner tube.

The source of pressurized fluid (air or liquid) may be provided below or remote from the sales counter top so as to be assessable only to the shopkeeper or clerk. The source of fluid may be a conventional pump or reservoir connected by the conduits to the cylinders so as to be activated only by the clerk or shopkeeper, simple switch controls, this providing automatic operation may be hidden behind the counter or merchandise display stand.

In the embodiment of FIGS. 5 and 6, automatic operation can be obtained by fixing the stabilizing block 44 so that it can define with the lower end of the outer tube 22, a fixed volume cylinder to which the pressurized fluid can be selectively fed. In this case, the pressure created in the fixed volume cylinder will be exerted to move only the spoke 26 located in the slot 52 of the rotatable cap 50. If no spoke 26 is aligned with the slot 52, no spoke will be freed from engagement with the ring 36.

It should be pointed out that while the invention has been described in conjunction with jewelry articles such as chains or necklaces, it must be realized that the invention can be effectively used for storing or holding a variety of articles. The invention effectively minimizes unauthorized removal of articles from the display device, and jewelry articles are highly susceptible to theft.

The display stand of the present invention may be constituted of metal tubing, ???? or brass being most suitable for their appearance. Other metals can, of course, be used. Woods may also be used.

Various embodiments and modification have been suggested herein and other changes and modifications will be obvious to those skilled in this art. Therefore, it is intended that the present disclosure be given wide scope and the invention limited only by claims appendant hereto.

What is claimed is:

1. A merchandise display stand comprising a vertical post assembly mounted on a substantially horizontal base having mounted on its upper end, a plurality of spokes upon which the merchandise is hung and a separate continuous ring, the spokes and the ring being selectively movable relative to each other between a first position wherein the ring abuts with the end of the spokes preventing removal of the merchandise, and a second position spaced from one or more of the spokes to free the ends thereof, permitting access to the merchandise.

2. The display stand according to claim 1, wherein the post comprises an assembly of an inner and outer tube, the spokes being mounted on one tube and the ring on the other, said tubes being telescoped one into the other so that on relative movement of the posts, the spokes and rings are selective movable into the first and second positions.

3. The display stand according to claim 1, including means for operating the spokes and ring whereby said ring and spokes are locked in the first position and open in the second position, said means selectively causing the ring and spokes to move on command.

4. The display stand according to claim 3, wherein said operating means comprises a fluid operated motor located within said post, a source of fluid under pressure and operator control means for feeding said fluid to said motor.

5. The display stand according to claim 4, wherein said fluid motor is double acting and is attached at one end to the outer tube and at its other end to said inner tube, said double acting motor at rest locks said spokes and ring in the first and second positions, respectively.

6. The display stand according to claim 1, wherein the ends of said spokes and the cross section of said ring are shaped so that said spokes and ring fit one within the other in the first position.

7. The display stand according to claim 6, wherein the cross section of said ring is U-shaped and the end of said spokes is raised in a conforming shape.

8. A merchandise display stand comprising a vertical post assembly mounted on a horizontal base having mounted at its upper end, a plurality of spokes upon which merchandise is hung, a separate continuous ring, said ring being fixed in horizontal position, each of said spokes comprising a radially extending leg and a vertical directed leg extending downwardly into said outer tube, a rotatable cap mounted on top of said outer tube having a radial slot, said cap being rotatable from a first angle preventing the upward movement of the spokes to a second angle allowing a selected spoke to move upwardly.

9. A merchandise display stand comprising a base, a vertical assembly and a display assembly comprising a plurality of radial merchandise holders and a ring member, said assembly being mounted on the upper end of said post assembly for movement of said radial holders and ring member relatively toward and away from each other and motive means, remotely operable to move said holders and ring.

* * * * *